US011583851B2

(12) United States Patent
Verrant et al.

(10) Patent No.: US 11,583,851 B2
(45) Date of Patent: Feb. 21, 2023

(54) BIOLOGIC FLUID ANALYSIS CARTRIDGE WITH SAMPLE HANDLING PORTION AND ANALYSIS CHAMBER PORTION

(71) Applicant: Abbott Point of Care, Inc., Princeton, NJ (US)

(72) Inventors: John A. Verrant, Solebury, PA (US); Niten V. Lalpuria, Mumbai (IN); Igor Nikonorov, Whitestone, NY (US); Darryn W. Unfricht, North Haven, CT (US); Benjamin Ports, Hamden, CT (US); Stephen C. Wardlaw, Lyme, CT (US); Robert A. Levine, Guilford, CT (US); Robert Holt, East Stroudsburg, PA (US); Kyle Hukari, Ewing, NJ (US)

(73) Assignee: Abbott Point of Care Inc., Princeton, NJ (US)

( * ) Notice: Subject to any disclaimer, the term of this patent is extended or adjusted under 35 U.S.C. 154(b) by 390 days.

(21) Appl. No.: 16/551,151

(22) Filed: Aug. 26, 2019

(65) Prior Publication Data

US 2019/0374943 A1 Dec. 12, 2019

Related U.S. Application Data

(60) Division of application No. 15/876,749, filed on Jan. 22, 2018, now Pat. No. 10,391,487, which is a (Continued)

(51) Int. Cl.
*B01L 3/00* (2006.01)

(52) U.S. Cl.
CPC ..... *B01L 3/502707* (2013.01); *B01L 3/5027* (2013.01); *B01L 3/50273* (2013.01); *B01L 2200/027* (2013.01); *B01L 2300/0861* (2013.01)

(58) Field of Classification Search
CPC ..... B01L 2200/0684; B01L 2200/027; B01L 3/5027; B01L 3/50273; B01L 2300/0822; (Continued)

(56) References Cited

U.S. PATENT DOCUMENTS 3,447,863 A 6/1969 Patterson
3,883,247 A 5/1975 Adams
(Continued)

FOREIGN PATENT DOCUMENTS

EP 0381501 8/1990
EP 0638799 2/1995
(Continued)

*Primary Examiner* — Dean Kwak
(74) *Attorney, Agent, or Firm* — Edward J. Baba; Mandar A. Joshi; Bozicevic, Field & Francis LLP

(57) ABSTRACT

A biological fluid analysis cartridge is provided. In certain embodiments, the cartridge includes a base plate extending between a sample handling portion and an analysis chamber portion. A handling upper panel is attached to the base plate within the sample handling portion. A collection port is at least partially formed with the handling upper panel. An initial channel and a secondary channel are formed between the handling upper panel and the base plate. The collection port and initial and secondary channels are in fluid communication with one another. A chamber upper panel is attached to the base plate within the analysis chamber portion. At least one analysis chamber is formed between the chamber upper panel and the base plate. The secondary channel and the analysis chamber are in fluid communication with one another.

10 Claims, 7 Drawing Sheets

Related U.S. Application Data continuation of application No. 13/341,618, filed on Dec. 30, 2011, now Pat. No. 9,873,118.

(60) Provisional application No. 61/470,142, filed on Mar. 31, 2011, provisional application No. 61/428,659, filed on Dec. 30, 2010.

(58) Field of Classification Search

CPC ..... B01L 2400/0487; B01L 3/502707; B01L 3/502715; B01L 3/508; B01L 2300/0816; B01L 2300/0838; B01L 2300/0861; B01L 2400/0406; B01L 9/527; G01N 30/6091; G01N 35/1095; B01F 13/0059

USPC ..... 422/502–505, 507, 521, 554, 68.1; 435/283.1, 287.2, 7.21; 436/180

See application file for complete search history.

(56) References Cited

U.S. PATENT DOCUMENTS 3,895,661 A 7/1975 Praglin et al.
3,916,205 A 10/1975 Kleinerman
3,925,166 A 12/1975 Blume
4,088,448 A 5/1978 Lilja et al.
4,171,866 A 10/1979 Tolles
4,264,560 A 4/1981 Natelson
4,427,294 A 1/1984 Nardo
4,550,417 A 10/1985 Nunogaki et al.
4,558,014 A 12/1985 Hirschfeld et al.
4,596,035 A 6/1986 Gershman et al.
4,596,829 A 6/1986 Takaya et al.
4,689,307 A 8/1987 Schwartz
4,790,640 A 12/1988 Nason
4,853,210 A 8/1989 Kass
4,902,624 A 2/1990 Columbus et al.
4,911,782 A 3/1990 Brown
4,950,455 A 8/1990 Smith
5,028,529 A 7/1991 Ericcson
5,122,284 A 6/1992 Braynin et al.
5,132,097 A 7/1992 Van Deusen et al.
5,169,601 A 12/1992 Ohta et al.
5,184,188 A 2/1993 Bull et al.
5,223,219 A 6/1993 Subramanian et al.
5,275,951 A 1/1994 Chow et al.
5,281,540 A 1/1994 Merkh et al.
5,316,952 A 5/1994 Brimhall
5,362,648 A 11/1994 Koreyasu et al.
5,376,252 A 12/1994 Ekstrom et al.
5,397,479 A 3/1995 Kass et al.
5,427,959 A 6/1995 Nishimura et al.
5,431,880 A 7/1995 Kramer
5,472,671 A 12/1995 Nilsson et al.
5,482,829 A 1/1996 Kass et al.
5,503,803 A 4/1996 Brown
5,538,691 A 7/1996 Tosa et al.
5,547,849 A 8/1996 Baer et al.
5,585,246 A 12/1996 Dubrow et al.
5,591,403 A 1/1997 Gavin et al.
5,608,519 A 3/1997 Gourley et al.
5,623,415 A 4/1997 O'Bryan et al.
5,627,041 A 5/1997 Shartle
5,638,828 A 6/1997 Lauks et al.
5,641,458 A 6/1997 Shockley, Jr. et al.
5,646,046 A 7/1997 Fischer
5,674,457 A 10/1997 Williamsson et al.
5,681,529 A 10/1997 Taguchi et al.
5,768,407 A 6/1998 Shen et al.
5,787,189 A 7/1998 Lee et al.
5,781,303 A 8/1998 Bendt
5,800,781 A 9/1998 Gavin et al.
5,879,628 A 3/1999 Ridgeway et al.
5,939,326 A 8/1999 Chupp et al.
5,948,686 A 9/1999 Wardlaw
5,968,453 A 10/1999 Shugart
5,985,218 A 11/1999 Goodale
6,004,821 A 12/1999 Levine et al.
6,016,367 A 1/2000 Benedetti et al.
6,016,712 A 1/2000 Warden et al.
6,022,734 A 2/2000 Wardlaw
6,106,778 A 8/2000 Oku et al.
6,130,098 A 10/2000 Handique et al.
6,150,178 A 11/2000 Cesarczyk et al.
6,159,368 A * 12/2000 Moring ..... G01N 35/0099 422/258
6,176,962 B1 1/2001 Soane et al.
6,188,474 B1 2/2001 Dussault et al.
6,235,536 B1 5/2001 Wardlaw
6,261,519 B1 7/2001 Harding et al.
6,365,111 B1 4/2002 Bass
6,387,331 B1 5/2002 Hunter
6,395,232 B1 5/2002 McBride
6,420,114 B1 7/2002 Bedilion et al.
6,448,090 B1 9/2002 McBride
6,468,807 B1 10/2002 Svensson et al.
6,521,182 B1 2/2003 Shartle et al.
6,537,501 B1 3/2003 Holl et al.
6,544,793 B2 4/2003 Berndt
6,551,554 B1 4/2003 Vermeiden et al.
6,573,988 B1 6/2003 Thomsen et al.
6,576,194 B1 6/2003 Holl et al.
6,597,438 B1 7/2003 Cabuz et al.
6,613,286 B2 9/2003 Braun, Sr. et al.
6,613,529 B2 9/2003 Bedilion et al.
6,623,701 B1 9/2003 Eichele et al.
6,656,431 B2 12/2003 Holl et al.
6,712,925 B1 3/2004 Holl et al.
6,723,290 B1 4/2004 Wardlaw
6,766,817 B2 7/2004 da Silva
6,783,736 B1 8/2004 Taylor et al.
6,838,055 B2 1/2005 Sando et al.
6,852,284 B1 2/2005 Holl et al.
6,866,823 B2 3/2005 Wardlaw
6,974,692 B2 12/2005 Chang
7,000,330 B2 2/2006 Schwichtenberg et al.
7,010,391 B2 3/2006 Handique et al.
7,220,593 B2 5/2007 Haubert et al.
7,226,562 B2 6/2007 Holl et al.
7,277,166 B2 10/2007 Padmanabhan et al.
7,329,538 B2 2/2008 Wainwright et al.
7,351,379 B2 4/2008 Schleifer
7,364,699 B2 4/2008 Charlton
7,381,374 B2 6/2008 Tsai et al.
7,468,160 B2 12/2008 Thompson et al.
7,641,856 B2 1/2010 Padmanabhan et al.
7,671,974 B2 3/2010 O'Mahony et al.
7,723,099 B2 5/2010 Miller et al.
7,731,901 B2 6/2010 Wardlaw
7,738,094 B2 6/2010 Goldberg
7,744,819 B2 6/2010 Berndtsson et al.
7,794,669 B2 9/2010 Gyonouchi et al.
7,802,467 B2 9/2010 Wang
7,871,813 B2 1/2011 Wyatt et al.
7,903,241 B2 3/2011 Wardlaw et al.
7,929,122 B2 4/2011 Wardlaw et al.
7,951,337 B2 5/2011 Vollert
7,951,599 B2 5/2011 Levine et al.
7,976,789 B2 7/2011 Kenis et al.
7,978,329 B2 7/2011 Padmanabhan et al.
8,025,854 B2 9/2011 Ohman et al.
8,033,162 B2 10/2011 Wang
8,071,051 B2 12/2011 Padmanabhan et al.
8,092,758 B2 1/2012 Lindberg et al.
8,097,225 B2 1/2012 Padmanabhan et al.
8,133,738 B2 3/2012 Levine et al.
8,158,434 B2 4/2012 Wardlaw
8,163,165 B2 4/2012 Offenbacher et al.
8,173,380 B2 5/2012 Yang et al.
2002/0001546 A1 1/2002 Hunter et al.
2002/0025279 A1 2/2002 Weigl
2002/0150505 A1* 10/2002 Reed ..... B01L 3/5025 422/63
2003/0012697 A1 1/2003 Hahn et al.
2004/0022686 A1 2/2004 Charles et al.

(56) References Cited

U.S. PATENT DOCUMENTS

| | | | |
|---|---|---|---|
| 2004/0072278 | A1 | 4/2004 | Chou et al. |
| 2005/0047972 | A1 | 3/2005 | Lauks et al. |
| 2005/0161669 | A1* | 7/2005 | Jovanovich ..... B01L 3/502738 257/48 |
| 2005/0249641 | A1* | 11/2005 | Blankenstein ..... F16K 99/0057 422/400 |
| 2006/0160164 | A1 | 7/2006 | Miller et al. |
| 2007/0036679 | A1 | 2/2007 | Munenaka |
| 2007/0111302 | A1 | 5/2007 | Handique et al. |
| 2007/0243117 | A1 | 10/2007 | Wardlaw |
| 2007/0254372 | A1 | 11/2007 | Bickel et al. |
| 2007/0025876 | A1 | 12/2007 | Nishijima et al. |
| 2008/0176253 | A1 | 7/2008 | Christodoulides et al. |
| 2008/0200343 | A1 | 8/2008 | Clemens et al. |
| 2008/0277494 | A1 | 11/2008 | Davies et al. |
| 2009/0011518 | A1 | 1/2009 | Lindberg |
| 2009/0047191 | A1 | 2/2009 | Zainiev et al. |
| 2009/0156966 | A1 | 6/2009 | Kontschieder |
| 2009/0286327 | A1 | 11/2009 | Cho et al. |
| 2010/0015606 | A1 | 1/2010 | Davies et al. |
| 2010/0021456 | A1 | 1/2010 | Miossec et al. |
| 2010/0109320 | A1 | 5/2010 | Davies et al. |
| 2010/0175999 | A1 | 7/2010 | Barlow et al. |
| 2010/0189338 | A1 | 7/2010 | Lin et al. |
| 2010/0209304 | A1 | 8/2010 | Sarofim |
| 2010/0297708 | A1 | 11/2010 | Collier et al. |
| 2011/0044862 | A1 | 2/2011 | Chang et al. |
| 2011/0136152 | A1 | 6/2011 | Lin et al. |
| 2011/0164803 | A1 | 7/2011 | Wang et al. |
| 2011/0192219 | A1 | 8/2011 | Miyamura |
| 2011/0201099 | A1 | 8/2011 | Anderson et al. |
| 2011/0207621 | A1 | 8/2011 | Montagu et al. |
| 2011/0214745 | A1 | 9/2011 | Zhou et al. |
| 2011/0244581 | A1 | 10/2011 | Nikonorov et al. |
| 2011/0293489 | A1 | 12/2011 | Zhou et al. |
| 2012/0004139 | A1 | 1/2012 | Staker |
| 2012/0034647 | A1 | 2/2012 | Herzog et al. |
| 2012/0082599 | A1 | 4/2012 | Weber |

FOREIGN PATENT DOCUMENTS

| | | |
|---|---|---|
| EP | 0778950 | 6/1997 |
| EP | 0788604 | 8/1997 |
| EP | 1245279 | 10/2002 |
| EP | 1701150 | 9/2006 |
| EP | 1932594 | 6/2008 |
| EP | 2040839 | 4/2009 |
| EP | 1390750 | 3/2011 |
| EP | 2050498 | 3/2012 |
| WO | 9511454 | 4/1995 |
| WO | 9624876 | 8/1996 |
| WO | 1999045386 | 9/1999 |
| WO | 2001032828 | 5/2001 |
| WO | 2005100539 | 10/2005 |
| WO | 2005111580 | 11/2005 |
| WO | 2005114142 | 12/2005 |
| WO | 2006124821 | 11/2006 |
| WO | 2007047908 | 4/2007 |
| WO | 2007075922 | 7/2007 |
| WO | 2007084232 | 7/2007 |
| WO | 07112332 | 10/2007 |
| WO | 2008079616 | 7/2008 |
| WO | 2008087405 | 7/2008 |
| WO | 2008157795 | 12/2008 |
| WO | 2009117652 | 9/2009 |
| WO | 2009117664 | 9/2009 |
| WO | 2009117682 | 9/2009 |
| WO | 2009117683 | 9/2009 |
| WO | 2009124179 | 10/2009 |
| WO | 2009124186 | 10/2009 |
| WO | 2009124190 | 10/2009 |
| WO | 2009126505 | 10/2009 |
| WO | 2009126800 | 10/2009 |
| WO | 2011075667 | 6/2011 |
| WO | 2011082342 | 7/2011 |
| WO | 2011116305 | 9/2011 |
| WO | 2012004723 | 1/2012 |
| WO | 2012019118 | 2/2012 |

* cited by examiner

BIOLOGIC FLUID ANALYSIS CARTRIDGE WITH SAMPLE HANDLING PORTION AND ANALYSIS CHAMBER PORTION

This application is a divisional of U.S. patent application Ser. No. 15/876,749 filed Jan. 22, 2018, which is a continuation of U.S. patent application Ser. No. 13/341,618 filed Dec. 30, 2011, which is entitled to the benefit of and incorporates by reference essential subject matter disclosed in the following U.S. Provisional patent applications: Ser. Nos. 61/428,659, filed Dec. 30, 2010; and 61/470,142, filed Mar. 31, 2011.

BACKGROUND OF THE INVENTION

1. Technical Field

The present invention relates to apparatus for biologic fluid analyses in general, and to cartridges for acquiring, processing, and containing biologic fluid samples for analysis in particular.

2. Background Information

Historically, biologic fluid samples such as whole blood, urine, cerebrospinal fluid, body cavity fluids, etc. have had their particulate or cellular contents evaluated by smearing a small undiluted amount of the fluid on a slide and evaluating that smear under a microscope. Reasonable results can be gained from such a smear, but the cell integrity, accuracy and reliability of the data depends largely on the technician's experience and technique.

In some instances, constituents within a biological fluid sample can be analyzed using impedance or optical flow cytometry. These techniques evaluate a flow of diluted fluid sample by passing the diluted flow through one or more orifices located relative to an impedance measuring device or an optical imaging device. A disadvantage of these techniques is that they require dilution of the sample, and fluid flow handling apparatus.

What is needed is an apparatus for evaluating a sample of substantially undiluted biologic fluid, one capable of providing accurate results, one that does not require sample fluid flow during evaluation, one that can perform particulate component analyses, and one that is cost-effective.

DISCLOSURE OF THE INVENTION

According to the present invention, a biological fluid analysis cartridge is provided. The cartridge includes a base plate extending between a sample handling portion and an analysis chamber portion. A handling upper panel is attached to the base plate within the sample handling portion. A collection port is at least partially formed with the handling upper panel. An initial channel and a secondary channel are formed between the handling upper panel and the base plate, and the collection port, initial channel, and secondary channel are in selective fluid communication with one another. A chamber upper panel is attached to the base plate within the analysis chamber portion. At least one analysis chamber is formed between the chamber upper panel and the base plate, and the secondary channel and the analysis chamber are in fluid communication with one another.

According to another aspect of the present invention, the cartridge includes an ante-chamber disposed between and in fluid communication with both the secondary channel and the analysis chamber.

According to another aspect of the present invention, a biological fluid sample analysis cartridge is provided having a sample handling portion and an analysis chamber portion. The sample handling portion has a collection port, an initial channel, and a secondary channel. The collection port, initial channel, and secondary channel are in selective fluid communication with one another. The analysis chamber portion includes at least one analysis chamber defined by an upper panel and a base panel. The analysis chamber is separated from the secondary channel, or from a fluid passage extending from the secondary channel, by an air gap which is sized to prevent capillary flow of fluid sample into the chamber absent a bulge of fluid sample extending across the air gap and into contact with the analysis chamber.

According to another aspect of the present invention, a biological fluid sample analysis cartridge is provided that includes a collection port, an initial channel, a secondary channel, and an analysis chamber passage. The secondary channel, collection port, and initial channel are selectively in fluid communication with one another. The analysis chamber passage is in fluid communication with the secondary channel, and is configured for connection to an analysis chamber which chamber is independent of the cartridge.

The features and advantages of the present invention will become apparent in light of the detailed description of the invention provided below, and as illustrated in the accompanying drawings.

DETAILED DESCRIPTION

Figure 1:
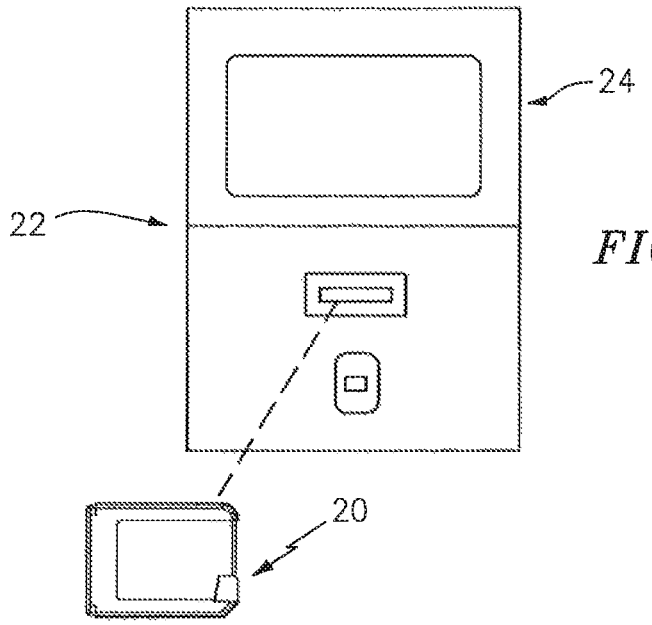
FIG. 1 illustrates a biologic fluid analysis system.
Figure 2:
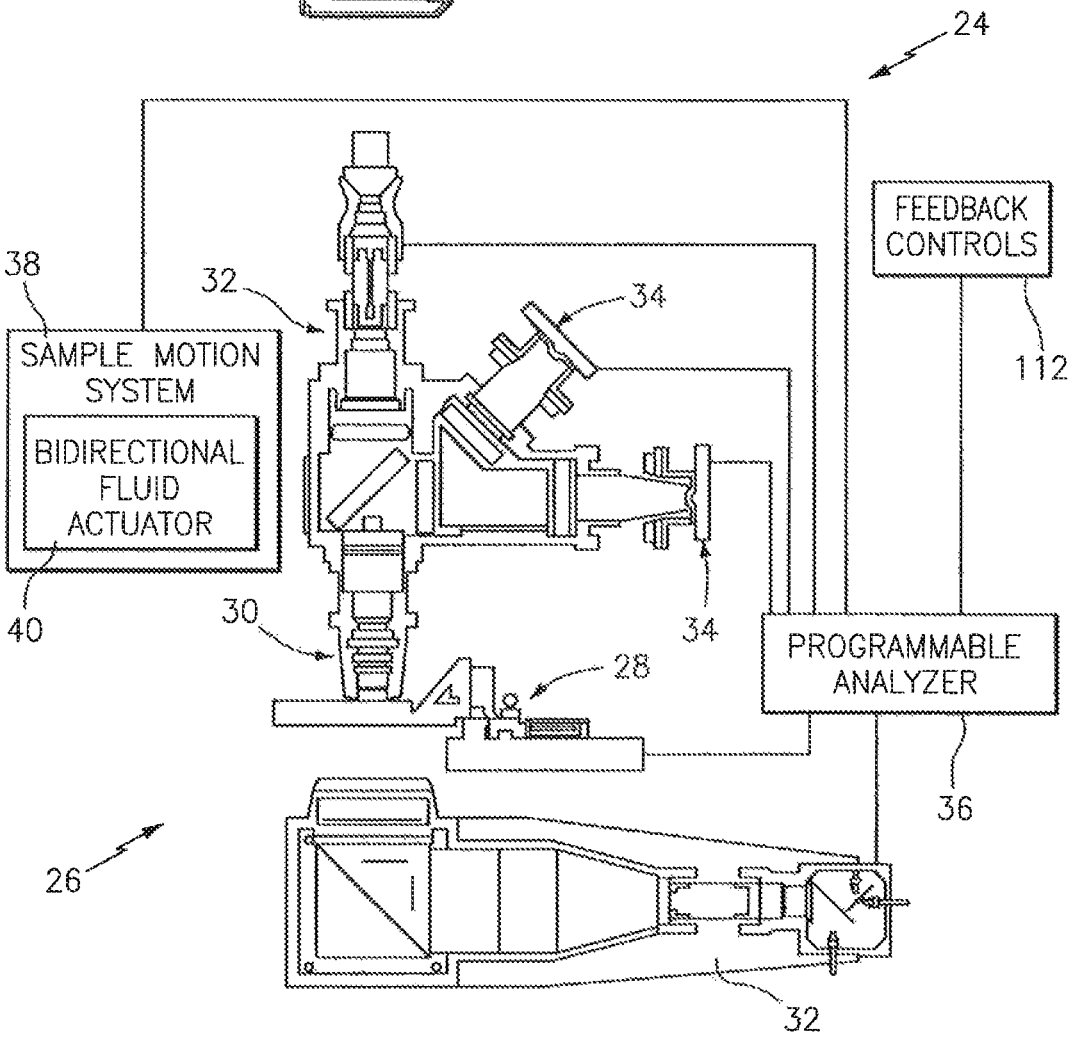
FIG. 2 is a schematic diagram of a fluid analysis device.

Referring to FIG. 1, the present biologic fluid sample cartridge 20 is operable to receive a biologic fluid sample such as a whole blood sample or other biologic fluid specimen. In most instances, the cartridge 20 is a part of an automated analysis system 22 that includes the cartridge 20 and an automated analysis device 24. An example of an analysis device 24 is schematically shown in FIG. 2, depicting its imaging hardware 26, a cartridge holding and manipulating device 28, a sample objective lens 30, a plurality of sample illuminators 32, an image dissector 34, and a programmable analyzer 36. One or both of the objective lens 30 and cartridge holding device 28 are movable toward and away from each other to change a relative focal position. The sample illuminators 32 illuminate the sample using light along predetermined wavelengths. Light transmitted through the sample, or fluoresced from the sample, is captured using the image dissector 34, and a signal representative of the captured light is sent to the programmable analyzer 36, where it is processed into an image. The imaging hardware described in U.S. Pat. No. 6,866,823 and U.S. Patent Application No. 61/371,020 (each of which is hereby incorporated by reference in its entirety) are acceptable types of imaging hardware 26 for the present analysis device 24. The present invention is not limited to use with the aforesaid imaging hardware 26, however.

Figure 18:
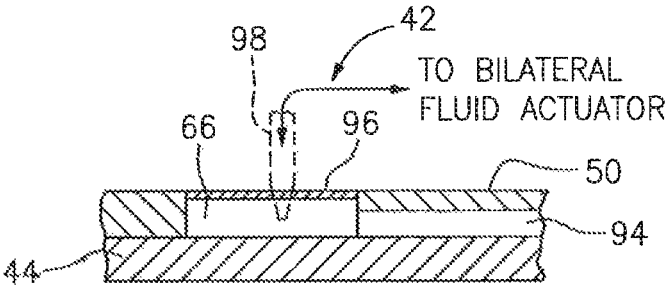
FIG. 18 is a diagrammatic partial sectional view of a cartridge, illustrating a fluid actuator port.

The programmable analyzer 36 includes a central processing unit (CPU) and is in communication with the cartridge holding and manipulating device 28, the sample illuminators 32, the image dissector 34, and a sample motion system 38. The CPU is adapted (e.g., programmed) to receive the signals and selectively perform the functions necessary to operate the cartridge holding and manipulating device 28, the sample illuminator 32, the image dissector 34, and the sample motion system 38. The sample motion system 38 includes a bidirectional fluid actuator 40 and a cartridge interface 42 (see FIG. 18). The bidirectional fluid actuator 40 is operable to produce fluid motive forces that can move fluid sample within the cartridge channels 62, 64 (e.g., see FIG. 3) in either axial direction (i.e., back and forth). The bidirectional actuator 40 can be controlled to perform one or more of: a) moving a sample bolus a given distance within the channels (e.g., between points "A" and "B"); b) cycling a sample bolus about a particular point at a predetermined amplitude (e.g., displacement stroke) and frequency (i.e., cycles per second); and c) moving (e.g., cycle) a sample bolus for a predetermined period of time. The term "sample bolus" is used herein to refer to a continuous body of fluid sample disposed within the cartridge 20; e.g., a continuous body of fluid sample disposed within one of the initial or secondary channels 62, 64 that fills a cross-section of channel, which cross-section is perpendicular to the axial length of the channel. An example of an acceptable bidirectional fluid actuator 40 is a piezo bending disk type pump, utilized with a driver for controlling the fluid actuator.

Figure 3:
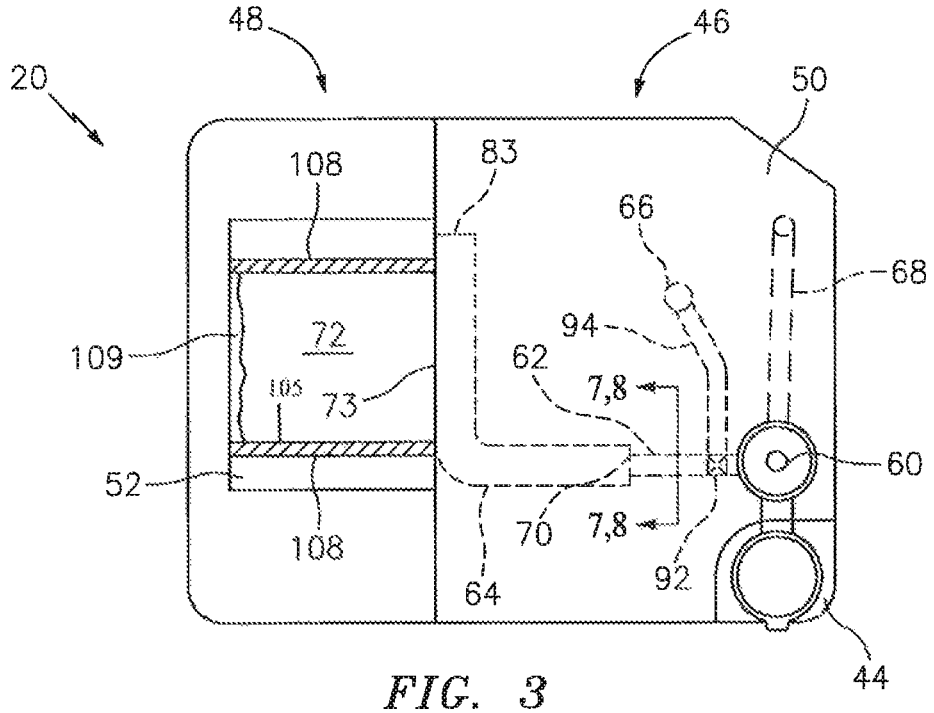
FIG. 3 is a diagrammatic top view of a cartridge embodiment.
Figure 4:
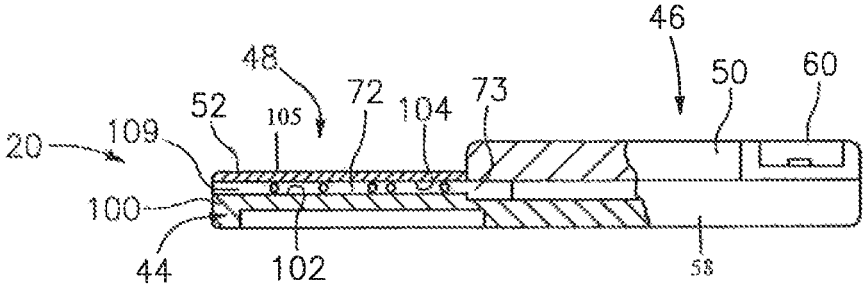
FIG. 4 is a partially sectioned side view of the cartridge embodiment shown in FIG. 3.
Figure 5:
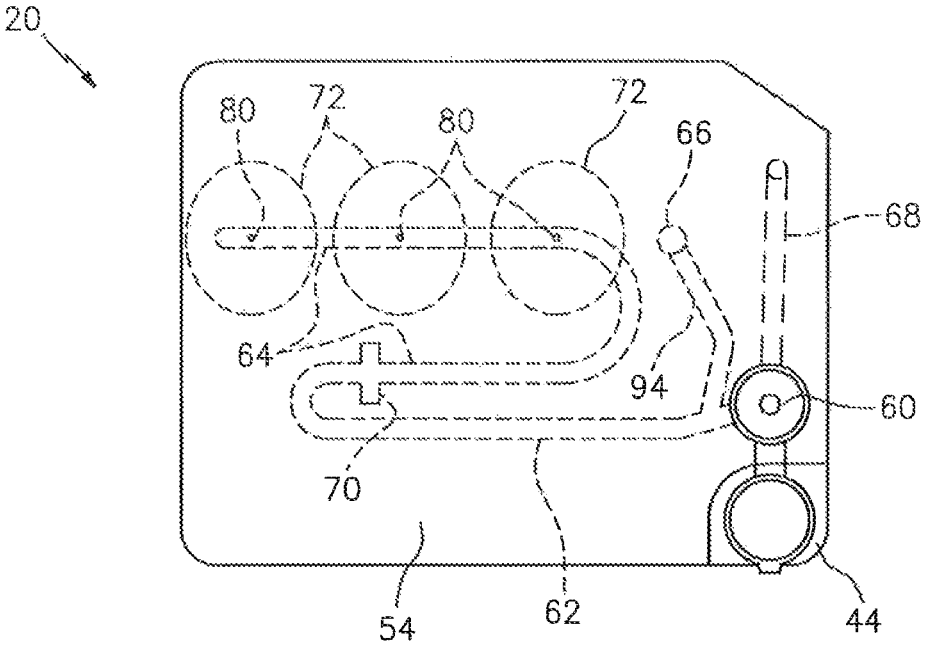
FIG. 5 is a diagrammatic top view of a cartridge embodiment.
Figure 6:
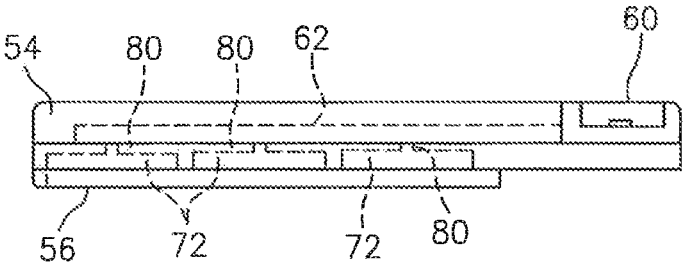
FIG. 6 is a side view of the cartridge embodiment shown in FIG. 5.

In a first embodiment shown in FIGS. 3 and 4, the cartridge 20 includes a substantially rigid base plate 44 that extends between a sample handling portion 46 and an analysis chamber portion 48. A handling upper panel 50 is attached to the base plate 44 in the sample handling portion 46, and a chamber upper panel 52 is attached to the base plate 44 in analysis chamber portion 48. A sealing material may be disposed between the base plate 44 and the respective handling upper panel 50 and chamber upper panel 52. The cartridge 20 embodiment shown in FIGS. 3 and 4 is depicted as a unitary structure where the sample handling portion 46 and the analysis chamber portion 48 are permanently attached to one another. In alternative embodiments, the sample handling portion 46 and the analysis chamber portion 48 may be selectively attachable and detachable from one another. For instance, it may be desirable to have a sample handling portion 46 that can be used at the collection site, which sample handling portion 46 can subsequently be attached to an analysis chamber portion 48 (or different types of analysis chamber portions 48). Another embodiment of the present cartridge 20 is shown in FIGS. 5 and 6, which embodiment includes a base plate 44, an upper panel 54, and a chamber cover panel 56. Initial and secondary channels 62, 64 (described below) are substantially disposed in the upper panel 54, and analysis chambers 72 are substantially formed in the base plate 44. Metering channels 80 extend between the secondary channel 64 and each chamber. The chamber cover panel 56 provides the bottom panel for the chambers.

Figure 7:
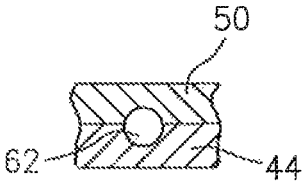
FIG. 7 is a diagrammatic sectional view of an embodiment of an initial channel.
Figure 8:
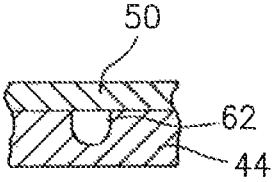
FIG. 8 is a diagrammatic sectional view of an embodiment of an initial channel.

Referring back to FIGS. 3 and 4, the sample handling portion 46 of the cartridge 20, consisting of the base plate handling section 58 and the handling section upper panel 50, includes a collection port 60, an initial channel 62, a secondary channel 64, and a fluid actuator port 66. The collection port 60, channels 62,64, and fluid actuator port 66 are formed in one of the base plate 44 and handling upper panel 50, or collectively formed between them. In those embodiments where an element is collectively formed between the base plate 44 and the handling upper panel 50, the degree to which the element is formed in one or the other of the base plate 44 and handling upper panel 50 can vary; e.g., 50% of the channel cross-sectional area (normal to axial) can be formed in one of the base plate 44 or upper panel 50, and the other 50% in the other, or 70% in one of the two and 30% in the other, etc. FIG. 7 diagrammatically illustrates a sectional view of the sample handling portion 46 of the cartridge 20, sectioned through the initial channel 62 to show approximately half of a channel 62 formed in the base plate 44 and the other half formed in the handling upper panel 50. FIG. 8 diagrammatically illustrates another channel embodiment where the handling upper panel 50 covers a channel disposed within the base plate 44, but does not add volume to the channel. The embodiments described below provide examples of the present cartridge 20, but the present cartridge 20 is not limited to these embodiments.

In the embodiment shown in FIG. 3, the handling upper panel 50 includes a collection port 60 for receiving a fluid sample. The collection port 60 is configured to accept a fluid sample from a container (e.g., deposited by needle, etc.), and can also be configured to accept a sample from a surface source (e.g., a finger prick). The collection port 60 has a partially spherical bowl-shape, which bowl-shape facilitates gravity collection of the sample. Other concave bowl geometries may be used alternatively. The bowl holds enough sample volume for the application at hand; e.g., for a blood sample analysis, a bowl volume of approximately 50 μl typically will be adequate.

The initial channel 62 is in fluid communication with the collection port 60 and is sized to draw sample out of the collection port 60 by capillary force. The term "fluid communication" is used herein to mean that a liquid passage exists between the structures (e.g., between the collection port and the initial channel), or out of a particular structure. The term "fluid communication" includes those configurations where a valve may be selectively used to close the passage or motive force may be selectively used to move fluid sample between structures. In some embodiments, the cartridge 20 may include an overflow channel 68 configured to accept and store sample in excess of that drawn into the initial channel 62. An overflow channel 68 having a cross-sectional geometry that permits the formation of capillary forces is desirable because fluid sample will automatically draw into the overflow channel via the capillary forces. An overflow channel 68 shaped to produce slightly less capillary force than is produced in the initial channel 62 (e.g., by having a slightly larger hydraulic diameter) is particularly useful because the initial channel 62 will fill first and then the remaining sample will be drawn into the overflow channel 68. The secondary channel 64 is in fluid communication with the initial channel 62, downstream of the initial channel 62. The intersection 70 between the initial channel 62 and the secondary channel 64 is configured (e.g., expanded area) to stop fluid travel by capillary force and thereby prevent fluid sample from exiting the initial channel 62 and entering the secondary channel 64, absent an external motive force.

Figure 12:
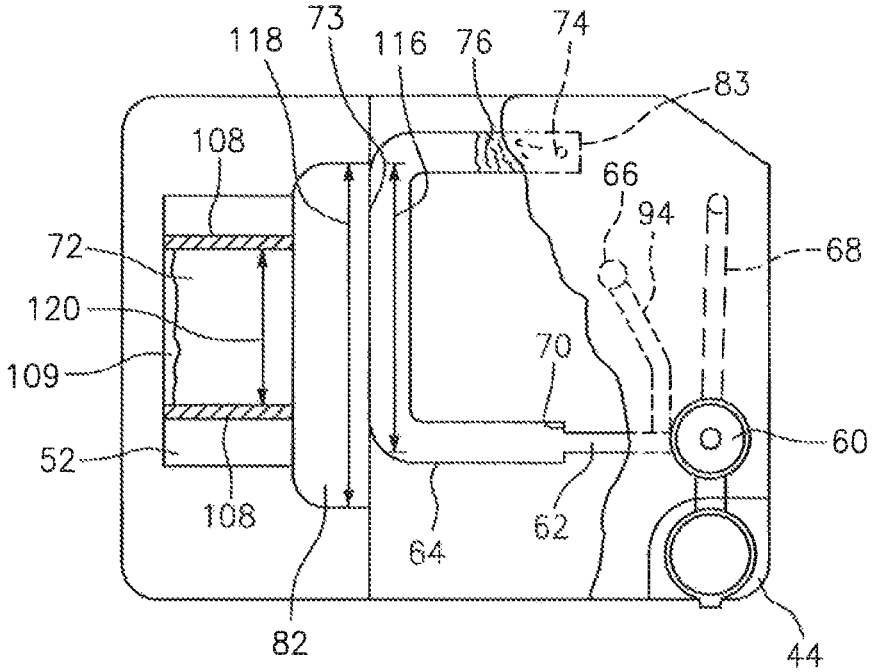
FIG. 12 is a diagrammatic top view of a cartridge, illustrating a secondary channel/analysis chamber interface embodiment.
Figure 13:
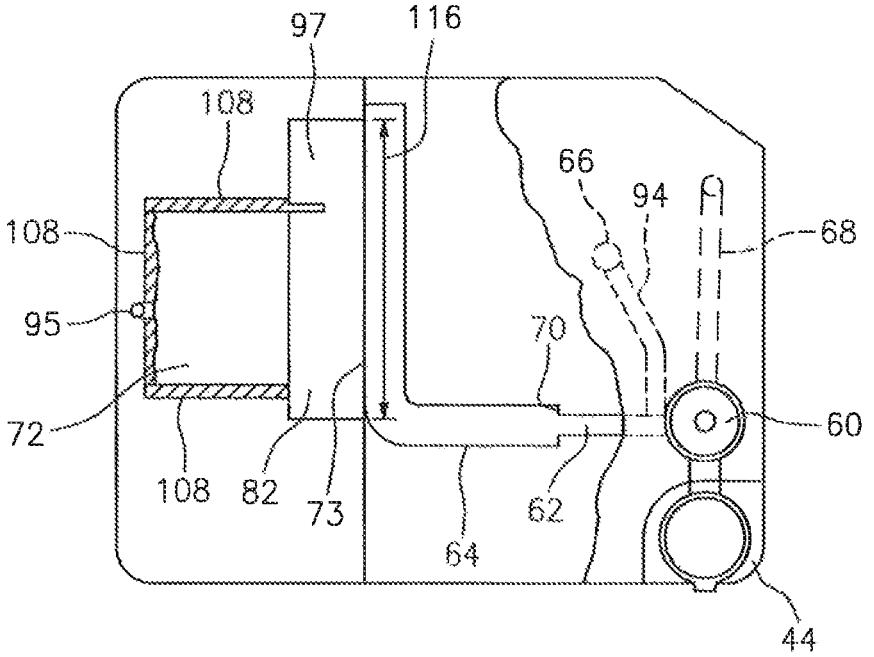
FIG. 13 is a diagrammatic top view of a cartridge, illustrating a secondary channel/analysis chamber interface embodiment.
Figure 15:
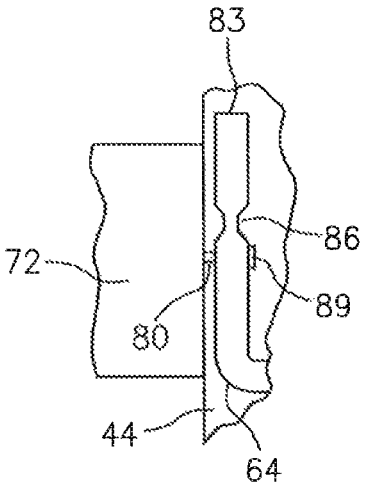
FIGS. 15-17 are diagrammatic illustrations of secondary channel configurations with metering channels.

The secondary channel 64 is in fluid communication with the analysis chamber 72 via an interface 73. In some embodiments, the secondary channel 64 may terminate at the analysis chamber 72, and in other embodiments, the secondary channel 64 may extend a distance beyond the interface 73 with the analysis chamber 72. In instances of the latter, an exhaust port 74 (e.g., see FIG. 12) may be disposed proximate the end of the secondary channel 64 to allow gas to pass out of the secondary channel 64. A gas permeable and liquid impermeable membrane 76 disposed relative to the exhaust port 74 can be used to allow passage of air, while at the same time preventing liquid sample from exiting the secondary channel 64.

Figure 21:
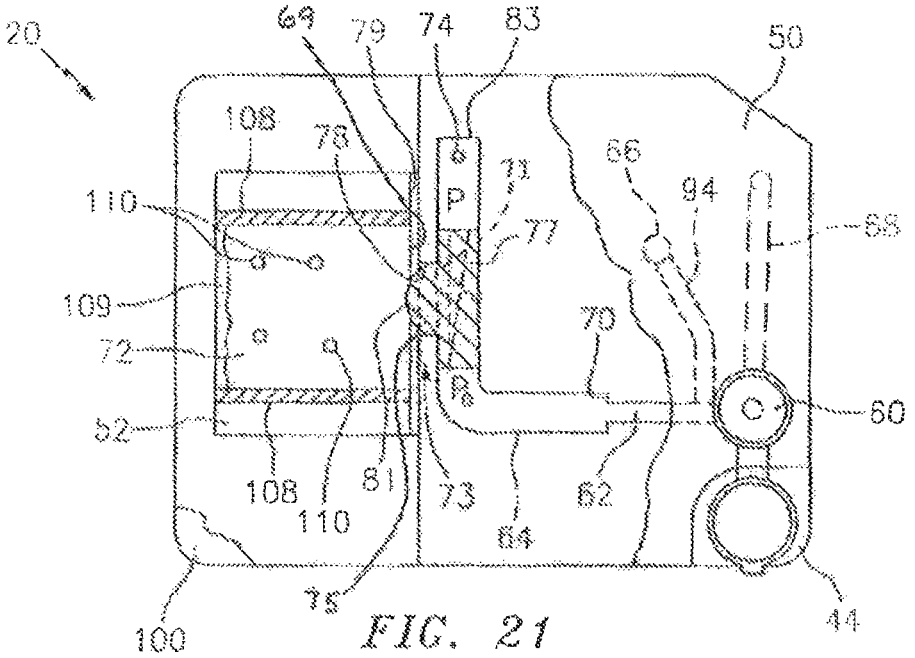
FIG. 21 is a diagrammatic top view of a cartridge, illustrating a secondary channel/analysis chamber interface embodiment.

The interface 73 between the secondary channel 64 and the analysis chamber 72 can assume several different configurations. In a first configuration, a portion of the secondary channel 64 is contiguous, and therefore in fluid communication, with the analysis chamber 72 (see FIG. 3). In a second configuration, an aperture 78 extends between the secondary channel 64 and the analysis chamber 72 (see FIG. 9). In this configuration, the aperture 78 may be sized larger than the maximum used for capillary attraction, but less than the entire fill edge of the analysis chamber 72. The larger aperture 78 can be useful in promoting a uniform distribution within the sample in the region proximate the aperture 78 (sometimes referred to as "edge fill configuration"). In a third configuration, a metering channel 80 sized to draw a volume of fluid sample out of the secondary channel 64 by capillary force (see FIG. 10) is in fluid communication with the secondary channel 64 and the analysis chamber 72. The metering channel is not limited to any particular geometry; e.g., it may be round or oval and constant along its length, or a truncated cone which varies along its length, combinations thereof, etc. In a fourth configuration, an ante-chamber 82 is disposed between and in fluid communication with both the secondary channel 64 and an edge of analysis chamber 72 (see FIG. 11). Fluid sample within the secondary channel 64 will pass into the ante-chamber 82, for example, by pressure from the bidirectional fluid actuator, or by gravity, or by capillary action, etc. In a fifth configuration (see FIG. 21), the analysis chamber 72 is separated from the aperture 78 extending from the secondary channel 64 by an air gap 79. The aperture 78 extends between an entry end 71 and an exit end 75. The gap 79 is sized such that a sample bolus 77 disposed within the aperture 78 cannot travel from the exit end 75 of the aperture 78 to the fill edge 69 of analysis chamber 72 by capillary force because of the air gap 79. The gap 79 is small enough such that a bulge 81 of the sample bolus 77 extending out from the exit end 75 of the aperture 78 can extend across the air gap 79 and contact the fill edge 69 of the analysis chamber 72, and then travel there between by capillary action. In those embodiments that do not include an aperture 78, the gap 79 may be disposed between the secondary channel 64 and the analysis chamber 72, or between the ante-chamber 82 and the analysis chamber 72, etc. The positioning of the air gap 79 is not limited to one between the aperture 78 and the analysis chamber 72. The interface 73 configurations shown in FIGS. 3, 9-15, 19, and 21-22 include an interface extending out from a lateral side of the secondary channel 64. The present invention is not limited to laterally positioned interfaces; e.g., an interface may be positioned at the terminal end of the secondary channel.

Portions of the interface 73 between the secondary channel 64 and the analysis chamber 72 can be formed by one or more of: a) a bead line of formable material (e.g., adhesive); b) a hydrophobic coating; or c) a physical configuration that stops capillary flow, examples of which are provided below. The interface 73 between the secondary channel 64 and the analysis chamber 72 can be disposed within one of the sample handling portion 46 or the analysis chamber portion 48, or some combination of the two.

Figure 22:
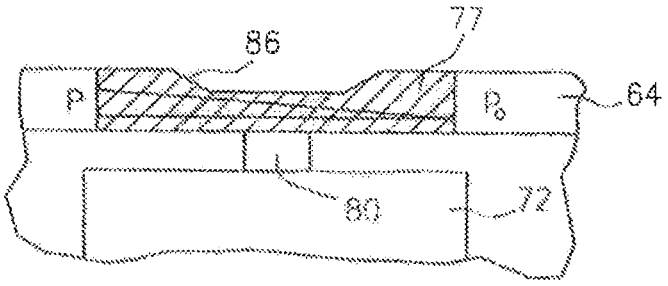
FIG. 22 is a diagrammatic illustration of a secondary channel/analysis chamber interface embodiment.
Figure 14:
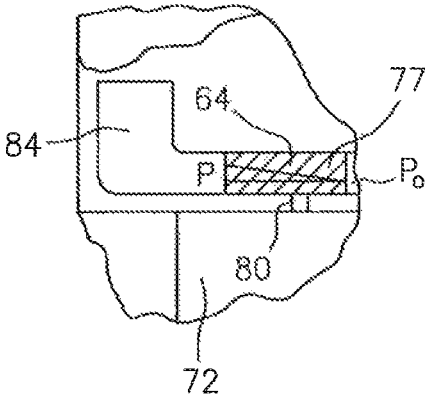
FIG. 14 is a partial view of a cartridge, illustrating a terminal end embodiment of a secondary channel.
Figure 17:
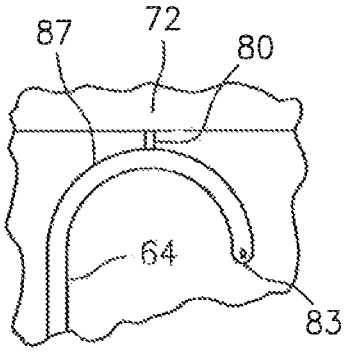
Figure 16:
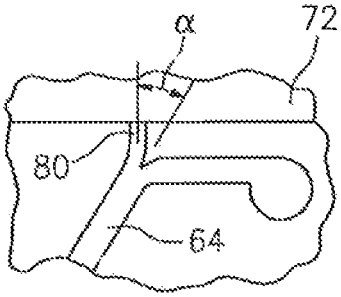

In the secondary channel/analysis chamber interface embodiments that include a metering channel 80, the metering channel 80 may be sized (e.g., hydraulic diameter of about 0.3 mm to 0.9 mm) to "meter" out an analysis sample portion from the sample bolus for examination within the analysis chamber 72. At these dimensions, there is resistance to the liquid flow that is inversely proportional to the diameter of the channel 80. If the channel surface is hydrophobic, the resistance to the fluid flow may be greater. To overcome the resistance, some embodiments of the present cartridge 20 include one or more features that facilitate the transfer of sample into the metering channel 80. For example, in some instances the terminal end 83 of the secondary channel 64 can include an aperture that restrictively allows air to escape (e.g., a restrictively sized exhaust port 74—see FIG. 10), or a closed reservoir 84 (e.g., see FIG. 14). As the sample bolus is pushed through the secondary channel 64, the air downstream of the bolus either cannot escape at all or not very quickly. The consequent pressure that builds up within the secondary channel 64 provides the impetus to force sample into the metering channel 80. FIG. 14 diagrammatically illustrates a difference in pressure (e.g., a pressure gradient $P-P_o$, where $P>P_o$) between the leading edge of the sample bolus 77 and the trailing edge of the sample bolus 77. In some embodiments, the cartridge is designed so that the sample bolus 77 subjected to the pressure gradient will be aligned with the metering channel 80 to facilitate passage of sample out of the secondary channel 64 and into the metering channel 80. Cartridge characteristics that can be used to align the sample bolus 77 with the metering channel 80 include, but are not limited to, the volume of the secondary channel 64 downstream of the metering channel 80, the size (or absence) of the exhaust port 74, the diameter of the secondary channel (which can be used to alter the length of a sample bolus 77 of a given volume within the secondary channel), etc. In an alternative embodiment, a flow impediment 86 (e.g., a channel constriction, see FIGS. 15 and 22) can be included in the secondary channel 64 and the metering channel 80 disposed proximate the impediment 86 (e.g., see FIG. 22), or on the upstream side of the impediment 86 (e.g., see FIG. 15). The impediment 86 can create a pressure difference (e.g., a pressure gradient) across the sample bolus 77, which pressure difference facilitates movement of sample into the metering channel 80. FIG. 22 diagrammatically illustrates a pressure gradient between the leading and trailing edges of the sample bolus 77 (e.g., a pressure gradient $P-P_o$, where $P>P_o$), proximate a flow impediment 86 within the secondary channel, which impediment 86 facilitates passage of sample out of the secondary channel 64 and into the metering channel 80. In addition to the pressure gradient, the impediment also causes elongation of the sample bolus 77 and thereby facilitates alignment of the bolus 77 with the metering channel 80. In fact, the elongated bolus 77 also has an elongated pressure gradient there across, and consequently the bolus 77 is less sensitive to positioning relative to the metering channel 80. As another alternative, the metering channel 80 can be disposed relative to the secondary channel 64 to take advantage of linear momentum built up in the bolus during axial channel movement. FIG. 16, for example, illustrates a metering channel 80 disposed at an acute angle "a" relative to the axial centerline of the secondary channel 64. FIG. 17 illustrates an embodiment where the metering channel 80 is disposed in the outer surface of an arcuate section 87 of the secondary channel 64, where centripetal forces acting on the sample bolus force the bolus radially outward and into the metering channel 80.

Some embodiments of the present cartridge 20 that include a metering channel 80 also include a pressure relief port 89 disposed at the same axial position on the secondary channel, opposite the metering channel 80. The pressure relief port 89 is designed to rupture at a pressure equal to or below the pressure that would cause expulsion of the sample out of the metering channel 80, thereby preventing excessive sample jetting into the analysis chamber. In the embodiment shown in FIG. 15, the relief port is in the form of a channel having a hydraulic diameter greater than that of the metering channel 80. The larger hydraulic diameter ensures that the pressure relief port 89 will fill with sample prior to the metering channel 80 filling with sample. If the pressure relief port 89 ruptures and dispels sample, the sample fluid is contained within the cartridge 20. As the relief port 89 ruptures, the excessive pressure is relieved. Subsequently, or at the same time, sample within the metering channel 80 can be drawn out of out the metering channel 80 and into analysis chamber 72 by capillary action. The relief port 89 can be sized to reduce pressure build up within the channel 64 and thereby decrease the chance of rapid expulsion of sample from the metering channel 80. Specifically, the relief port 89 can be sized such that the pressure relief provided by the relief port 89 would be just enough to transfer the sample slowly to the analysis chamber 72 from the metering channel 80.

Figure 11:
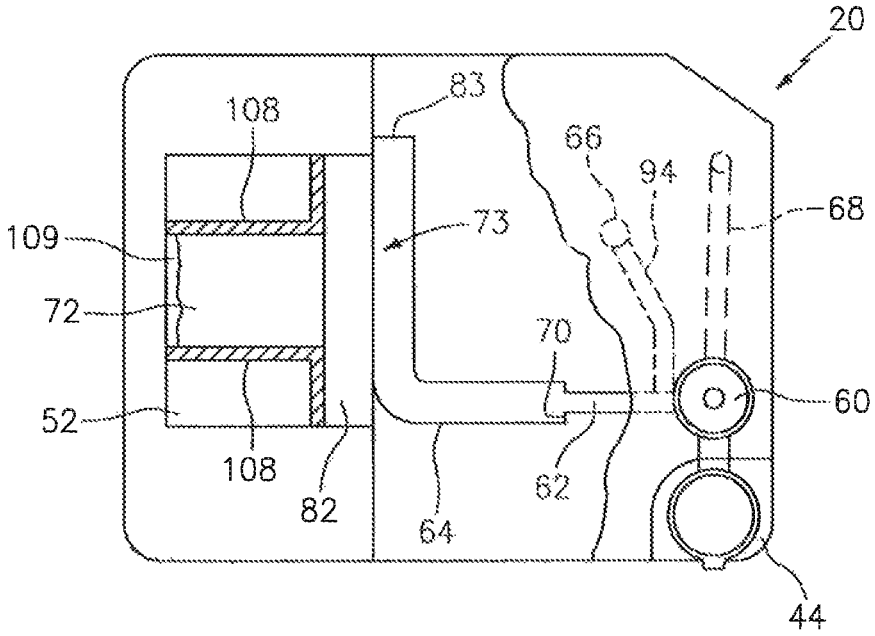
FIG. 11 is a diagrammatic top view of a cartridge, illustrating a secondary channel/analysis chamber interface embodiment.

In a first embodiment of the ante-chamber 82 shown in FIG. 11, the ante-chamber 82 has a volume that is less than the analysis chamber 72. During operation, substantially all of the sample volume that passes into the ante-chamber 82 travels further into the analysis chamber 72 (e.g., only inconsequential traces of the sample may remain in the ante-chamber). In this embodiment, because substantially the entire sample volume from the ante-chamber 82 eventually resides within the analysis chamber 72, capillary forces developed within the analysis chamber 72 act on the chamber upper panel 52. In a second embodiment of the ante-chamber 82 shown in FIG. 12, the ante-chamber 82 has a volume that is greater than the analysis chamber 72. During operation of this embodiment, some amount of sample volume remains within the ante-chamber 82 after the analysis chamber 72 is completely filled. In this embodiment, capillary forces developed within both the ante-chamber 82 and the analysis chamber 72 act on the chamber upper panel 52. An advantage of the second ante-chamber 82 embodiment is that the volume of the sample that passes into the analysis chamber 72 is substantially uniform between cartridge 20.

In both these ante-chamber embodiments: a) at least a substantial portion of the analysis chamber 72 lateral boundaries 108 allows venting of air from within the analysis chamber 72 (e.g., a hydrophobic coating 109 forms one or more of the lateral boundaries 108 of the analysis chamber 72); b) the height 90 of the ante-chamber 82 is greater than the height 106 of the analysis chamber 72 (see FIG. 20); and c) the lateral width 116 of the passage between the secondary channel 64 and the ante-chamber 82 is preferably sized (see FIG. 12) to allow sample passage there between during a period of time that is short enough to avoid the development of any appreciable constituent distribution non-uniformity (e.g., settling) within the sample bolus under normal operating conditions. In an embodiment of the cartridge 20 shown in FIG. 13, the cartridge is similar to that shown in FIG. 12, except that there is a relatively small air vent 95 disposed in the lateral boundaries 108 of the analysis chamber 72. The vent 95 is positioned at a position substantially opposite the sample inlet to allow the analysis chamber 72 to completely fill with sample. In this embodiment, the excess fluid sample residing within the ante-chamber 82 and the relatively small vent hole substantially minimize the potential for sample evaporation during a clinically reasonable period of time. The ante-chamber 82 embodiment shown in FIG. 13 also includes an optional side compartment 97 that can be used for additional analyses; e.g., using reagents disposed within the side compartment 97 that admix with a portion of the sample passing into the ante-chamber 82 from the secondary channel 64. An example of such an additional analysis is a reference cyanmethemoglogin measurement that may be made on lysed blood using light at about 540 nm.

The ante-chamber interface configuration provides several advantages. For example, the ante-chamber 82 provides a rapid (relative to other configurations) means for withdrawing a substantial amount of the sample bolus from the secondary channel 64. The relatively rapid sample movement counters the potential for sample settling and adsorption (e.g., on surfaces) that increases as a function of time for a quiescently residing sample bolus. Another advantage is that the lateral width 118 of the ante-chamber 82 (see FIG. 12), which is at least substantially the same as the lateral width 120 of the analysis chamber 72, facilitates lateral distribution of the sample within the analysis chamber 72. The substantially similar lateral widths 118,120 also avoid problems associated with a "point" source. For example, a conventional pipette expelling a fluid sample into the analysis chamber 72 increases the possibility that separators 88 disposed proximate the discharge area will be forced further into the chamber 72 with the fluid sample. As a result, an area within the chamber 72 without the separators 88 necessary for spacing may be created. Still another advantage of an ante-chamber 82 is that the time in which it takes a fluid sample (e.g., whole blood) to pass from the secondary channel 64 into the ante-chamber 82 is relatively consistent. As a result, the process of filling the ante-chamber 82, and therefore the analysis chamber 72, can be controlled as a function of time thereby simplifying controls for the analysis system 22; e.g., eliminate the need for sensors.

The height 90 of the ante-chamber 82 can be established, for example, by disposing separators 88 having a height (e.g., diameter) greater than those of the separators 88 used within the analysis chamber 72. The use of separators 88 is described in greater detail below. For example, if 4.0 μm diameter separators 88 are disposed within the analysis chamber 72, the ante-chamber 82 may include a plurality of separators 88 (e.g., each the same diameter within a range of 20 μm-50.0 μm) to achieve the greater ante-chamber height.

In some embodiments of the present cartridge 20, one or more reagents (e.g., heparin, EDTA, etc.) are deposited within the initial channel 62. The reagents may also be deposited in the other areas (e.g., collection port 60, secondary channel 64, analysis chambers 72, etc.).

In some embodiments, a valve 92 (see FIG. 3) is disposed within the cartridge 20 at a position (e.g., within the initial channel 62) to prevent fluid flow between a portion of the initial channel 62 and the collection port 60. The valve 92 is selectively actuable between an open position and a closed position. In the open position, the valve 92 allows fluid flow between the collection port 60 and the entire initial channel 62. In the closed position, the valve 92 prevents fluid flow between at least a portion of the initial channel 62 and the collection port 60.

The fluid actuator port 66 is configured to engage a sample motion system 38 (see FIG. 2) incorporated with the analysis device 24 and to permit a fluid motive force (e.g., positive air pressure and/or suction) to access the cartridge 20 to cause the movement of fluid sample within cartridge 20. The fluid actuator port 66 is in fluid communication with the initial channel 62; e.g., via a channel 94 extending between the actuator port 66 and the initial channel 62. An example of a fluid actuator port 66 is a cavity within the cartridge 20 covered by a cap that includes a rupturable membrane 96 (e.g., see FIG. 18). In this embodiment, the sample motion system 38 can be configured to include a probe 98 operable to pierce the rupturable membrane 96 and thereby create fluid communication between sample motion system 38 and the initial and secondary channels 62, 64. The present invention is not limited to this particular fluid actuator port embodiment.

Figure 20:
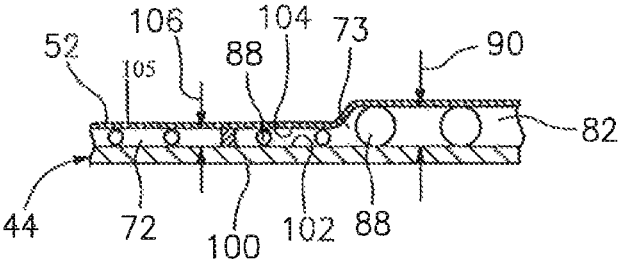
FIG. 20 is a diagrammatic partial sectional view of an analysis chamber and an ante-chamber.

Referring to FIGS. 3, 4, and 20, the analysis chamber portion 48 of the cartridge 20, formed by the base plate chamber section 100 and the chamber upper panel 52, includes at least one analysis chamber 72 in fluid communication with the secondary channel 64. The analysis chamber 72 is formed between the opposing surfaces 102, 104 respectively (i.e., the "interior surfaces") of the base plate chamber section 100 and the chamber upper panel 52, at least one of which is transparent. For purposes of this description, both the chamber upper panel 52 and at least a portion of the base plate chamber section 100 will be described as being transparent to light, but the invention is not so limited. The base plate chamber section 100 may be planar or may have one or more cavities disposed therein. In those instances where the analysis chamber 72 is aligned with a cavity, the interior surface 102 of the base plate chamber section is the bottom surface of the cavity. Within the analysis chamber 72, the interior surfaces 102,104 of the base plate chamber section 100 and the chamber upper panel 52 are spaced apart from one another and are configured to receive a fluid sample there between for image analysis; e.g., the sample can quiescently reside within the chamber 72 between the interior surfaces 102, 104 during imaging. The distance 106 between the opposing interior surfaces of the two panels (i.e., "chamber height 106") is such that a biologic fluid sample disposed between the two surfaces will contact both surfaces. The analysis chamber 72 is further defined by lateral boundaries that contain the lateral spread of the sample between the interior surfaces 102,104; e.g., a lateral boundary 109 may be formed by a hydrophobic coating applied to one or both interior surfaces 102,104, or by a bead of adhesive (or other formable) material 108 extending between the interior surfaces 102,104, or by a physical configuration that stops lateral capillary flow of the sample. A bead of adhesive material 108 provides the advantage of also attaching the chamber upper panel 52 to the base plate chamber section 100. One or both of the interior surfaces 102,104 within the analysis chamber 72 may be coated with a hydrophilic material to facilitate sample travel within the chamber. The exterior surface 105 of the chamber upper panel may be coated with a hydrophobic material to inhibit sample from traveling onto the exterior surface 105 during transfer to the chamber 72 and possibly obscuring light passage through the panel. Hydrophobic material may be added to other surfaces to prevent sample (or other liquid) from collecting on the surface and possibly obscuring light passage through the surface.

Within the portion of the analysis chamber 72 where sample is imaged, the interior surfaces 102,104 are typically, but not necessarily, substantially parallel to one another. The alignment between the base plate chamber section 100 and the chamber upper panel 52 defines an area wherein light can be transmitted perpendicular to one panel and it will pass through that panel, the sample, and the other panel as well, if the other panel is also transparent.

Figure 19:
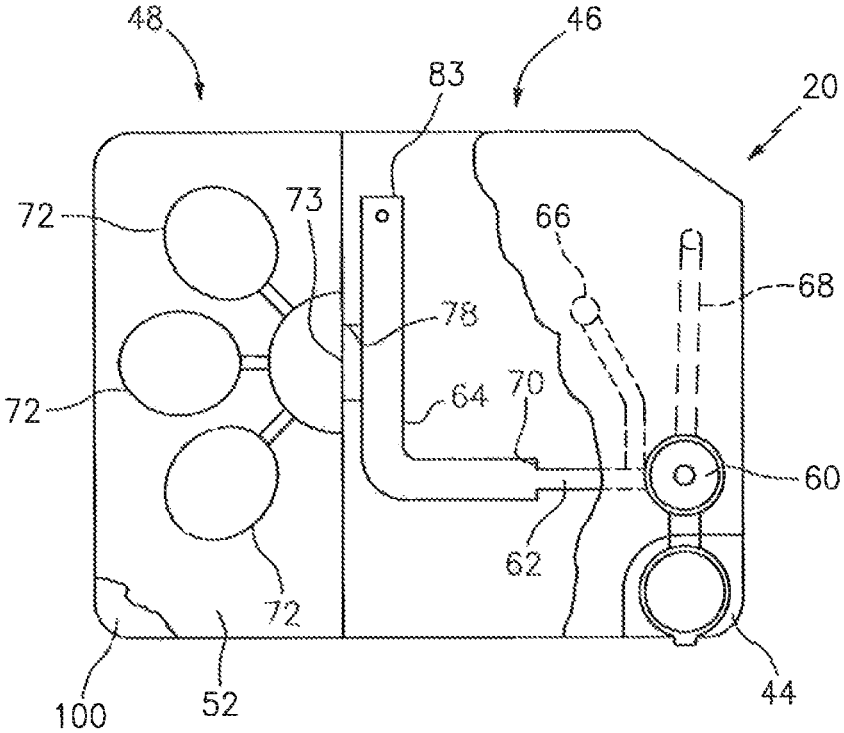
FIG. 19 is a diagrammatic top view of a cartridge, illustrating an embodiment of an analysis chamber portion.

In some embodiments of the present cartridge 20, the analysis chamber portion 48 includes a plurality of analysis chambers 72. As an example, FIG. 19 illustrates an embodiment wherein the analysis chamber portion 48 includes three analysis chambers 72, each in fluid communication with the secondary channel 64. Each analysis chamber 72 may be configured for a different analysis on different parts of the same fluid sample. For example, if the fluid sample consists of whole blood, a first chamber could be configured (e.g., coated with a zwittergen) to facilitate red blood cell (RBC) analyses (e.g., enumeration, cell volume, morphological assessment, etc.). A second chamber could be configured to facilitate hemoglobin analyses that require RBC lysing. A third chamber could be configured to facilitate white blood cell analyses (e.g., cell staining, etc.). In each of these instances, the characteristics that facilitate one type of analysis (stains, lysing, etc.) would be present in the chamber 72 where it is needed, and absent in other chambers 72 where it would interfere or otherwise hinder the analysis. In addition to the presence/absence of reagents and dyes, the chambers 72 can also have different physical characteristics operable to facilitate the analysis at hand. For example, a chamber 72 designated for volumetric measurements of unlysed RBCs or WBCs having a chamber height of about 4.0 μm is particularly useful. In contrast, a chamber 72 configured for a measurement of colorimetric hemoglobin in solution can have a height of about 50.0 μm. In addition, chambers 72 may include geometric features (e.g., steps, cavities, objects, etc.) to facilitate analyses. The advantages of including multiple analysis chambers 72 include, for example, an increase in the number of analyses that can be performed on a single fluid sample, a decrease in the amount of time required to perform the analyses, and the ability to perform a plurality of different analyses (e.g., CD4/CD8 and other fluorescent antibody detection and imaging, WBC and platelet phenotype determinations, etc.), including those that cannot be performed on the same sample volume.

In addition, the inclusion of multiple analysis chambers 72 within a cartridge 20 provides a quality assurance mechanism. For example, a cartridge 20 can be designed to include a plurality of analysis chambers 72, with each chamber 72 manufactured to have the same characteristics. In the event it is determined that the characteristics of one of the chambers 72 was manufactured outside acceptable specifications (e.g., separator inter-distance density), another of the chambers 72 can be used and the cartridge 20 salvaged.

Referring to FIG. 20, at least three separators 88 are disposed within the analysis chamber 72, in contact with both the base plate chamber section 100 and the chamber upper panel 52. In a preferred embodiment, the separators 88 are structures independent of both the base plate 44 and the chamber upper panel 52. The separators 88 are disposed within the chamber in random distribution with an inter-separator spatial density sufficient to ensure an acceptably uniform separation between the interior surfaces of the base plate chamber section 100 and chamber upper panel 52.

Referring to FIG. 20, at least one of chamber upper panel 52 or the separators 88 is sufficiently flexible to permit the chamber height to approximate the mean height of the separators 88. The relative flexibility provides an analysis chamber 72 having a substantially uniform height despite the possibility of minor geometric variations in the separators 88 due to manufacturing tolerances. For example, in those embodiments where the separators 88 are relatively flexible, the larger separators 88 compress to allow most separators 88 to contact the interior surfaces 102,104 of both panels, thereby making the chamber height 90, 106 substantially equal to the mean separator diameter. In contrast, if the chamber upper panel 52 is formed from a material more flexible than the separators 88, the chamber upper panel 52 will overlay the separators 88 and to the extent that a particular separator is larger than the surrounding separators 88, the chamber upper panel will flex around the larger separator 88 in a tent-like fashion. In this manner, although small local areas of the chamber 72 will deviate from the mean chamber height, the mean height of all the chamber sub-areas (including the tented areas) will be very close to that of the mean separator 88 diameter. The capillary forces acting on the sample provide the force necessary to compress the separators 88, or flex the chamber upper panel 52. Examples of acceptable separators 88 include polystyrene spherical beads that are commercially available, for example, from Thermo Scientific of Fremont, Calif., U.S.A., catalogue no. 4204A, in four micron (4 μm) diameter. An example of an acceptable analysis chamber 72 configuration is described in U.S. Patent Publication No. 2007/0243117, which is hereby incorporated by reference in its entirety.

In those embodiments where the chamber upper panel 52 is held against the separators 88 in both the ante-chamber 82 and the analysis chamber 72 by capillary forces exerted by the liquid sample within the chamber, the chamber upper panel 52 is sufficiently flexible to contact substantially all of the separators 88 within both the ante-chamber 82 and the analysis chamber 72.

Figure 9:
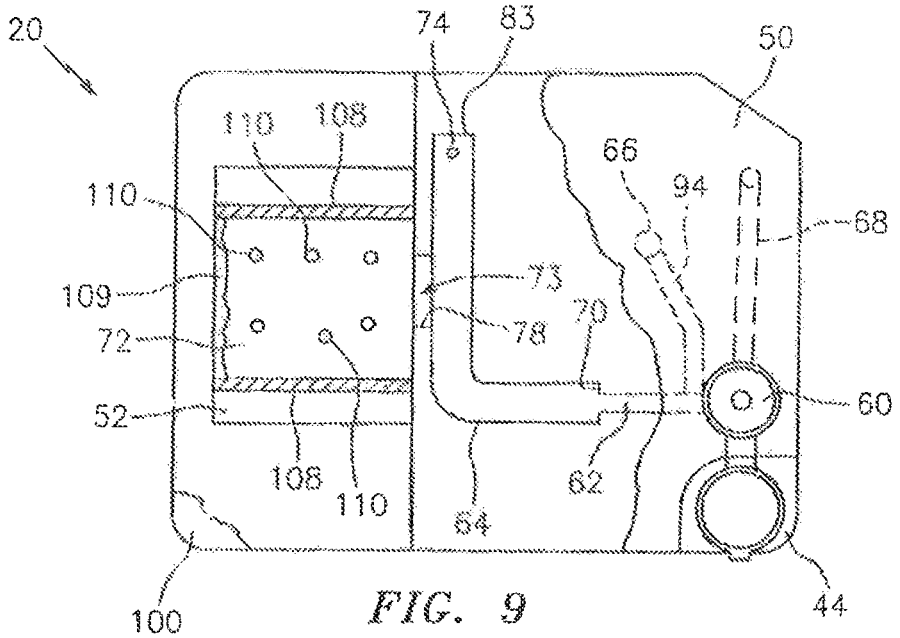
FIG. 9 is a diagrammatic top view of a cartridge, illustrating a secondary channel/analysis chamber interface embodiment.
Figure 10:
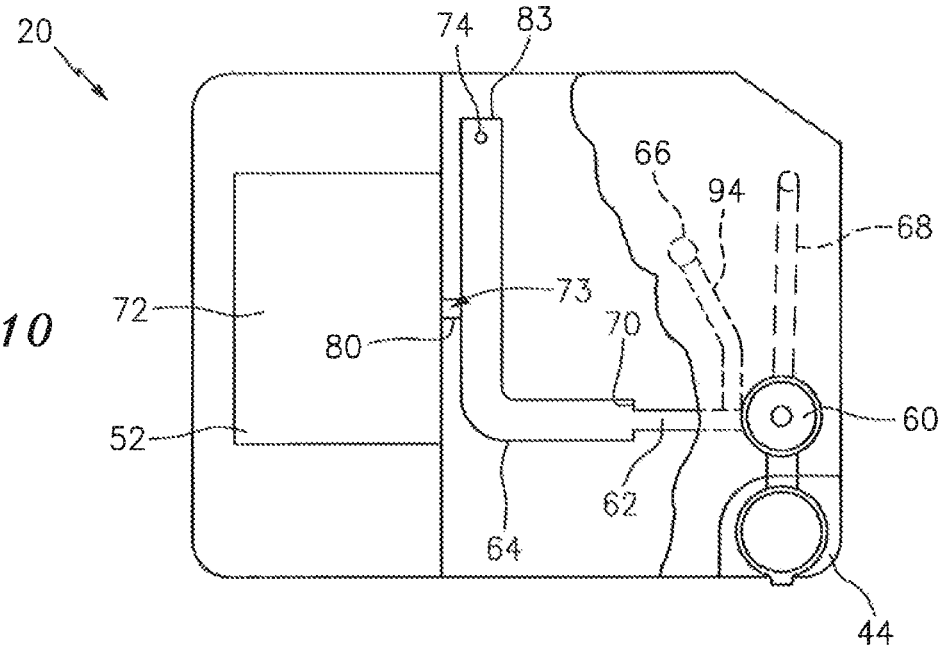
FIG. 10 is a diagrammatic top view of a cartridge, illustrating a secondary channel/analysis chamber interface embodiment.

Referring to FIG. 9, in some applications it is possible that chamber upper panel 52 may be deflected away from the base plate chamber section 100 for reasons including, but not limited to, excessive surface tension of the fluid, excessive flexibility of the chamber upper panel 52, and insufficient tension exerted by the fluid sample between the chamber upper panel 52 and the base plate chamber section 100. Because such deflection can negatively impact a volume determination of a given field of the analysis chamber 72, some embodiments of the present cartridge 20 include one or more small bodies 110 (referred to as "dots"; see FIGS. 10 and 21) of adhesive extending between the interior surfaces 102,104 of the chamber 72, where the term "small" is used to describe a cross-sectional area that is individually and collectively insignificant relative to the cross-sectional area of the analysis chamber 72, and therefore does not affect the analysis at hand. The number of the adhesive dots 110 is at least the minimum number required to eliminate any appreciable lifting of the chamber upper panel 52. The adhesive dots 110 may include a colorant that facilitates one or more of dot identification, height determination between the interior surfaces, and optical density determination for calibration purposes; e.g., the colorant may render the dots "colorless" at the wavelengths used in the analysis, but visible at other wavelengths.

Examples of acceptable chamber upper panel 52 materials include transparent plastic film, such as acrylic, polystyrene, polyethylene teraphthalate (PET), cyclic olefin polymer (COP), cyclic olefin copolymer (COC), or the like, with the chamber upper panel 52 having a thickness of approximately twenty-three microns (23μ).

The analysis chamber 72 is typically sized to hold about 0.2 to 1.0 μl of sample, but the chamber 72 is not limited to any particular volume capacity, and the capacity can vary to suit the analysis application. The chamber 72 is operable to quiescently hold a liquid sample. The term "quiescent" is used to describe that the sample is deposited within the chamber 72 for analysis, and is not purposefully moved during the analysis. To the extent that motion is present within the blood sample, it will predominantly be due to Brownian motion of the blood sample's formed constituents, which motion is not disabling of the use of this invention.

Referring to FIGS. 2 and 3, in the operation of the cartridge 20 a fluid sample (e.g., a substantially undiluted whole blood sample) is deposited in the collection port 60. The sample is drawn into the initial channel 62 by capillary action. The sample travels within the initial channel 62 until the leading edge of the sample encounters the intersection 70 between the initial channel 62 and the secondary channel 64, which intersection 70 is configured to prevent capillary forces from drawing the fluid sample into the secondary channel 64. In those embodiments that include an overflow channel 68, if the initial channel 62 is filled with sample and some amount of sample still resides in the collection port 60, then the excess amount is drawn into the overflow channel 68.

As indicated above, in certain embodiments of the present cartridge 20 one or more reagents (e.g., heparin or EDTA in a whole blood analysis) may be deposited within the initial channel 62 and/or the collection port 60. As the sample passes through the initial channel 62, the reagents are admixed to some degree with the sample as it travels there through.

After the end-user inserts the cartridge 20 into the analysis device 24, the analysis device 24 locates and positions the cartridge 20. In the case of a whole blood sample that was collected and not immediately analyzed, constituents within the sample bolus (e.g., RBCs, WBCs, platelets, and plasma) can settle and become stratified (or otherwise non-uniformly distributed) over time. In such cases, there is considerable advantage in manipulating the sample bolus prior to analysis so that the constituents become substantially uniformly distributed within the sample. In addition, in many applications there is also considerable advantage in uniformly mixing reagents with the sample bolus. To create a substantially uniform distribution of constituents and/or reagents within the sample bolus, the analysis device 24 provides a signal to the bidirectional fluid actuator 40 to provide fluid motive force adequate to act on the sample bolus residing within the initial channel 62; e.g., to move the sample bolus forwards, backwards, or cyclically within the initial channel 62, or combinations thereof.

Once the sample residing within the initial channel 62 is mixed sufficiently to create a sample with a substantially uniformly constituent distribution, the bidirectional fluid actuator 40 may be operated to move the sample bolus from the initial channel 62 to the secondary channel 64. Once the sample bolus is located within the secondary channel 64, the sample can be actuated according to the requirements of the analysis at hand. For example, in those analyses where it is desirable to have the sample admix with reagent "A" before mixing with a dye "B", an appropriate amount of reagent "A" (e.g., an anticoagulant—EDTA) can be positioned upstream of an appropriate amount of dye "B" within the channel. To facilitate mixing at either location, the sample bolus can be cycled at the location of the reagent "A", and subsequently cycled at the position where dye "B" is located. Feedback positioning controls 112 can be used to sense and control sample bolus positioning. In addition, in some instances the bolus can be actuated with a combination of cycling and axial motion within the channel 64. The specific algorithm of movement and cycling is selected relative to the analysis at hand, the reagents to be mixed, etc. The present invention is not limited to any particular re-suspension/mixing algorithm.

Subsequently, the sample motion system 38 is operated to move the sample bolus forward in the secondary channel 64 for transfer into the analysis chamber 72. The positioning of the sample bolus is chosen based on the configuration of the interface 73 between the secondary channel 64 and the analysis chamber 72 utilized within the cartridge 20. For example, if the interface 73 is a contiguous passage or aperture extending between the secondary channel 64 and an edge of the analysis chamber 72, or a passage extending between the secondary channel 64 and an edge of an ante-chamber 82, then positioning the bolus to align with the contiguous region will result in the sample transferring to the analysis chamber 72 by virtue of the pressure difference, gravity, capillary action, etc. As indicated above, the movement of sample fluid into the ante-chamber 82 can be controlled as a function of time. In some instances, the sample bolus can be specifically manipulated to produce a pressure gradient within the bolus between the leading and trailing edges of the bolus.

The terminal end 83 of the secondary channel 64 is configured to compliment the interface 73 between the secondary channel 64 and the analysis chamber 72. For example, in the embodiment of a contiguous passage or aperture extending between the secondary channel 64 and an edge of the analysis chamber 72, the secondary channel 64 may terminate in close proximity to and downstream of the aforesaid passage or aperture. In these embodiments, motive force against the sample bolus or within the secondary channel 64 can create the difference in pressure that facilitates sample movement into the analysis chamber 72. In some embodiments, a gas permeable and liquid impermeable membrane 76 disposed at the terminal end 83 of the secondary channel 64 allows the air within the channel 64 to escape through an exhaust port 74, but prevents the liquid sample from escaping.

In those cartridge 20 embodiments that include a metering channel 80 or an ante-chamber 82 sized to receive a volume of sample that is less than the volume of the analysis chamber 72 (e.g., see FIG. 12), substantially all of the sample will pass into the analysis chamber 72 and will distribute therein via capillary forces. In those cartridge 20 embodiments that include an ante-chamber 82 sized to receive a volume of sample that is greater than the volume of the analysis chamber 72 (e.g., see FIGS. 13 and 14), then a portion of the sample will pass into the analysis chamber 72 via capillary forces and a portion will remain in the ante-chamber 82. Once the sample is quiescently disposed within the analysis chamber 72, the sample can be imaged for analysis purposes.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed herein as the best mode contemplated for carrying out this invention.

What is claimed is:

1. A biological fluid sample analysis cartridge, comprising:

a fluid channel;

a fluid passage extending between an entry end and an exit end, wherein the entry end is in fluid communication with the fluid channel; and an analysis chamber defined by an upper panel having an interior surface and a base panel having an interior surface, wherein the interior surface of the upper panel faces the interior surface of the base panel, and wherein a lateral edge of the upper panel and a lateral edge of the base panel define a fill edge of the analysis chamber;

wherein the fill edge of the analysis chamber is separated from the fluid passage exit end by an air gap that defines a separation distance between the fill edge of the analysis chamber and the fluid passage exit end, which said fill edge of the analysis chamber is therefore not connected to the fluid passage exit end, wherein the separation distance is configured such that a self-contained body of the biological fluid sample can extend across the air gap and maintain contact between the fluid passage exit end and the fill edge of the analysis chamber.

2. The cartridge of claim 1, wherein the fill edge of the analysis chamber extends a lateral distance, and the exit end of the fluid passage extends a lateral distance, and the lateral distance of the fill edge of the analysis chamber is greater than the fluid passage exit end lateral distance.

3. The cartridge of claim 1, wherein the fluid passage is an ante-chamber.

4. The cartridge of claim 3, wherein the ante-chamber is configured to draw the biological fluid sample from the fluid channel by capillary action.

5. The cartridge of claim 3, wherein the ante-chamber extends a lateral distance and the fill edge of the analysis chamber extends a lateral distance, and the ante-chamber lateral distance is substantially similar to the lateral distance of the fill edge of the analysis chamber.

6. The cartridge of claim 3, wherein the ante-chamber has a volume and the analysis chamber has a volume, and wherein the volume of the analysis chamber is less than the volume of the ante-chamber.

7. The cartridge of claim 3, wherein the ante-chamber has a height and the analysis chamber has a height, and wherein the height of the ante-chamber is greater than the height of the analysis chamber.

8. The cartridge of claim 1, wherein the fluid passage is in fluid communication with a lateral side of the fluid channel.

9. The cartridge of claim 1, wherein the fluid passage is in fluid communication with a terminal end of the channel.

10. The cartridge of claim 1, wherein the fill edge of the analysis chamber is configured to permit biological fluid sample in contact with the fill edge of the analysis chamber to enter the analysis chamber by capillary action.

* * * * *